US005335682A

United States Patent [19]

Yoshimura et al.

[11] Patent Number: 5,335,682

[45] Date of Patent: Aug. 9, 1994

[54] APPARATUS FOR DI CAN SURFACE TREATMENT

[75] Inventors: Takayuki Yoshimura, Omiya; Yoshiteru Kondo, Tokyo; Yoshimasa Matsumura, Sagamihara; Kiyoaki Inoue, Hachioji, all of Japan

[73] Assignee: Daiwa Can Company, Tokyo, Japan

[21] Appl. No.: 83,295

[22] Filed: Jun. 29, 1993

Related U.S. Application Data

[62] Division of Ser. No. 986,038, Dec. 4, 1992.

[30] Foreign Application Priority Data

Dec. 6, 1991 [JP] Japan ..... 3-348592

[51] Int. Cl.[5] ..... B08B 3/02

[52] U.S. Cl. ..... 134/72; 134/131

[58] Field of Search ..... 134/60, 68, 72, 79, 134/83, 131, 152, 125, 165; 118/315, 316, 317; 198/445, 446

[56] References Cited

U.S. PATENT DOCUMENTS 3,049,135 8/1962 Kuhl et al. ..... 134/72
3,442,708 5/1969 Huddle ..... 134/32
3,952,698 4/1976 Beyer et al. ..... 134/68 X
4,319,930 3/1982 Yano et al. ..... 134/60 X

*Primary Examiner*—Philip R. Coe
*Attorney, Agent, or Firm*—Wenderoth, Lind & Ponack

[57] ABSTRACT

Inverted DI cans are fed by a conveyer having partitions in a plurality of rows such that they are spaced apart in each row, and treatment liquid is sprayed against the travelling cans from above and below the center of each row. The liquid is sprayed from above in a uniform and a full-cone pattern greater in area than the top surface of the can and from below also in a full-cone pattern or in a fan-shaped pattern narrow in the widthwise direction of the conveyer and greater in length than the can open end diameter. The liquid is further sprayed against the travelling cans from side nozzles on the opposite sides of and symmetric with respect to the center of each row. The side walls of the cans are thus washed without contact of adjacent cans in the direction of travel of the cans. The washing force is increased in the space between adjacent cans in the direction of travel to prevent washing irregularities and thus permit uniform surface treatment of the inner and outer surfaces of the cans.

5 Claims, 8 Drawing Sheets

APPARATUS FOR DI CAN SURFACE TREATMENT

This is a divisional application of Ser. No. 07/986,038, filed Dec. 4, 1992, pending.

FIELD OF THE INVENTION

This invention relates to an apparatus for surface treatment of drawn and ironed can bodies that are manufactured by blanking and drawing a metal strip into cups and re-drawing and ironing the cups to form thin-walled can bodies. More particularly, the invention relates to an apparatus for treating surfaces of drawn and ironed can bodies right after they are trimmed to a predetermined height, without causing can-to-can contacts. The term "surface treatment" used herein means a series of washing and surface treatment processes including "pre-wash" for the removal of lubricant used in preceding forming operations, "chemical treatment" for treating metal surfaces by chemical solutions, and "post-wash" for removing chemical solutions and final rinsing.

BACKGROUND OF THE INVENTION

In recent years, demands for drawn and ironed cans, or so called DI cans have been growing remarkably. Largely because of seam-free and aesthetically improved features, DI cans have been extensively used for canning beer, juices and other.

DI cans are produced commercially on a mass production scale and DI can manufacturing processes generally include blanking and drawing metal strips into shallow cups, redrawing and ironing the cups to form hollow tubular bodies with thin sidewalls, and trimming the open ends of the tubular bodies to a predetermined height. Then, the trimmed bodies are subjected to surface treatment processes, in which sprays of treatment liquid such as degreasing solutions, industrial water, chemical solutions and deionized water are directed against the inner and outer surfaces of the trimmed bodies. Subsequently, the bodies are dried in a drying oven, decorated externally, coated internally with a protective coating and finally subjected to necking and flanging and formed into complete can bodies.

A line of production equipment to perform the above processes and manufacture DI cans is typically very long and many can manufacturers have been experiencing difficulties in accommodating such a long line in their available space. Various efforts have so far been made to develop compact lines by making component machines of the equipment more compact and, for example, a device for the surface treatment, which essentially occupies the largest installation space among components of the line equipment, has ordinarily been designed to accommodate a drying oven in a piece of machinery for continuous processes.

One of the most extensively adopted systems for the surface treatment in the industry uses an endless mesh conveyor belt having large numbers of openings that allow passage of sprays of the treatment liquid, and the conveyor belt progresses through a pre-wash zone, a treatment zone and a post-wash zone accommodated in a long tunnel and partitioned one from another, so that trimmed can bodies placed in a mass in an inverted position with their bottoms up off the conveyor belt receive sprays of the treatment liquid directed from a series of spray nozzles positioned above and beneath the upper flight of the conveyor belt (U.S. Pat. No. 3,952,698).

Nowadays, DI cans having extremely thin sidewalls or so called lightweight DI cans have become available in the industry as the result of efforts of various manufacturers for savings of manufacturing costs. Since these cans are very light, however, they can be readily tilted or displaced to come into contact with another on the conveyor belt or tipped over by impingements of sprays during the surface treatment, and such can-to-can contacts and tipping over often result in defects such as poor and irregular wash and inadequate surface finish. Such defects may adversely affect adhesion performance and corrosion resistance of a film of the protective coating and extremely deteriorate luster of the coated or decorated surfaces to an extent that commercial values of finished cans may be completely destroyed.

U.S. Pat. No. 3,291,143 discloses an apparatus for surface treatment of lightweight cans as illustrated in FIG. 8 (a side sectional view of the apparatus) and FIG. 9 (a sectional view taken along line IX—IX in FIG. 8). The apparatus comprises a surface treatment housing 15, a lower endless conveyor belt 11 which progresses with cans K held thereon through the housing, a plurality of lower nozzles 13 disposed beneath the lower conveyor belt 11, a plurality of upper nozzles 14 disposed above the cans K in the housing and arranged to face the lower nozzles 13, and an upper endless mesh conveyor belt 12 surrounding the upper nozzles 13 and progressing in the same direction as the lower conveyor belt 11. The specification further describes that the lower flight **12*a* of the upper conveyor belt 12 should preferably be spaced upwardly by about 0.3 to 0.6 cm (i.e., $\frac{1}{8}$ to $\frac{1}{4}$ inches) from the bottoms of the cans K held in the inverted state on the lower mesh conveyor belt 11** and fed continuously in the direction of the arrow Z.

As cans K travel through the housing, they receive sprays of the treatment liquid directed from the upper and lower nozzles 13 and 14. The spray pressure of the lower nozzles is set so as to overcome that of the upper nozzles to urge the cans upwardly against the lower flight of the upper conveyor belt 12, and with this arrangement, it is indicated that even light weight cans may not be tilted or displaced to come into contact with one another or tipped over during the surface treatment.

From the viewpoint of productivity in a mass production, the apparatus disclosed in U.S. Pat. No. 3,952,698 is certainly desirable as the mesh conveyor belt of the apparatus for holding cans has no partitioning and thus permits a large number of cans to be placed on it. With such apparatus, however, cans on the conveyor belt may come into contact with one another during the processes so that contacting portions and adjacent areas of the cans may not receive adequate sprays.

Since the upwardly and downwardly directed sprays in the apparatus will not prevent contact of cans, occasional occurrence of defects due to can-to-can contacts is unavoidable with such apparatus. It should be noted that, in such apparatus, sprays of the treatment liquid just flow through gaps between adjacent can bodies, so that when a can has just advanced past the sprays a negative pressure is created momentarily in the gaps to pull an adjacent can, causing can-to-can contacts and resultant defects.

Further, varied flow of cans into such apparatus may cause additional problems. Depending on the flow of cans, they may be pushed by one another and forced to slide over the surface of the conveyor belt, so that sidewall portions near the bottom rim of a can are rubbed with those of another to develop a band of dark scars in the rubbed portions and nicks are caused at the edge of the open end due to friction with the conveyor belt. Also, if a can is pushed excessively, it may jump out of the way or tip over. On the other hand, the apparatus disclosed in the U.S. Pat. No. 3,291,143 permits efficient washing of the inner and outer surfaces of light weight-cans by relatively high fluid pressure of sprays directed thereto as the cans are held against the lower flight of the upper conveyor by the pressure of the upwardly directed sprays. Since fluid pressures created in the lateral directions by the sprays are not controlled in such apparatus, however, the cans may be moved in the lateral directions due to imbalanced spray pressure and brought into contact with one another to cause defects, particularly when the cans are closely spaced from one another in an attempt to improve productivity. In the above apparatus, lateral forces of upwardly and downwardly directed sprays are not balanced as the upper and lower sprays are not aligned with each other.

As discussed above, neither of the aforementioned prior art surface treatment apparatus has adequate measures for eliminating of can-to-can contacts and resultant defects as well as certain incidental damage to drawn and ironed weight cans.

SUMMARY OF THE INVENTION

An object of the present invention is to overcome the aforementioned difficulties encountered in the conventional surface treatment by providing an improved method of surface treatment and a novel apparatus therefor that enables complete elimination of tipping over and can-to-can contacts without using any special can holding mechanism and ensures efficient and thorough surface treatment of drawn and ironed lightweight can bodies without causing defects such as partly unclean or inadequately treated spots.

The apparatus for surface treatment of drawn and ironed can bodies, comprises a tunnel accommodating a series of pre-wash, treatment and post-wash zones, an endless conveyor belt of rods in the form of an open framework travelling through such zones for carrying thereon inverted trimmed can bodies to be treated and a plurality of upper and lower nozzles for respectively directing sprays of surface treatment liquid of a full-cone, pyramid or thin fan-shaped spray pattern upwardly from beneath and downwardly from above the upper flight of the conveyor belt at the respective zones against the inner and outer surfaces of the can bodies. The conveyor belt also has a plurality of partitions projecting outwardly from the outer surface of the conveyor belt and extending in the direction of travel thereof to form a plurality of can feeding sections to receive the can bodies, each such section having a width slightly greater than the diameter of the can bodies. The upper nozzles are full-cone or pyramid type spray nozzles, the lower nozzles are full-cone, pyramid or fan-shaped flat type spray nozzles, and the upper and lower spray nozzles are arranged in a plurality of pairs, a pair of upper and lower nozzles being coaxially aligned with each other. The apparatus is further provided with a plurality of fan-shaped flat type side spray nozzles which are arranged in a plurality of pairs along each can feeding section and paired side spray nozzles are disposed at transversely symmetrical positions to each other with respect to the center of the can feeding section and spaced apart from each other by a distance equal to or greater than the diameter of the can bodies.

According to the invention, adjacent can bodies are spaced apart from each other by at least 2 mm in any partitioned row. Otherwise, if the spacing is less than 2 mm, the sprays of treatment liquid directed from the side spray nozzles may not flow down smoothly along the sidewalls of the can bodies but can be retained in the form of a film in the space between the can bodies due to the surface tension, and also the can bodies may come into contact with each other if they are tilted back and forth slightly as they travel to or away from each upper nozzle due to slight fluctuations of forces of the downwardly directed sprays they receive at their bottom surfaces of a domed configuration, so that adequate surface treatment of the can bodies can not be attained.

For the above reasons, any two most adjacent can bodies to be treated must be spaced apart from each other by at least 2 mm but, on the contrary, too large of a spacing between can bodies adversely affects productivity and economy of operations and therefore it is preferable from practical points of view to set the spacing at a maximum of 5 mm.

Also, it is preferable that the fan-shaped sprays directed from the side spray nozzles cover, at both sides of the can feeding section, a narrow and vertically elongate area having a width in the range of 2 to 10 mm. If the width is less than 2 mm, sufficient surface treatment can not be obtained and if the width exceeds 10 mm, on the other hand, excessive impact of the sprays may cause a tipping over of the can bodies.

DETAILED DESCRIPTION OF THE PREFERRED EMBODIMENT

Now, an embodiment of a method and apparatus according to the invention will be described in detail with reference to the drawings.

Figure 1:
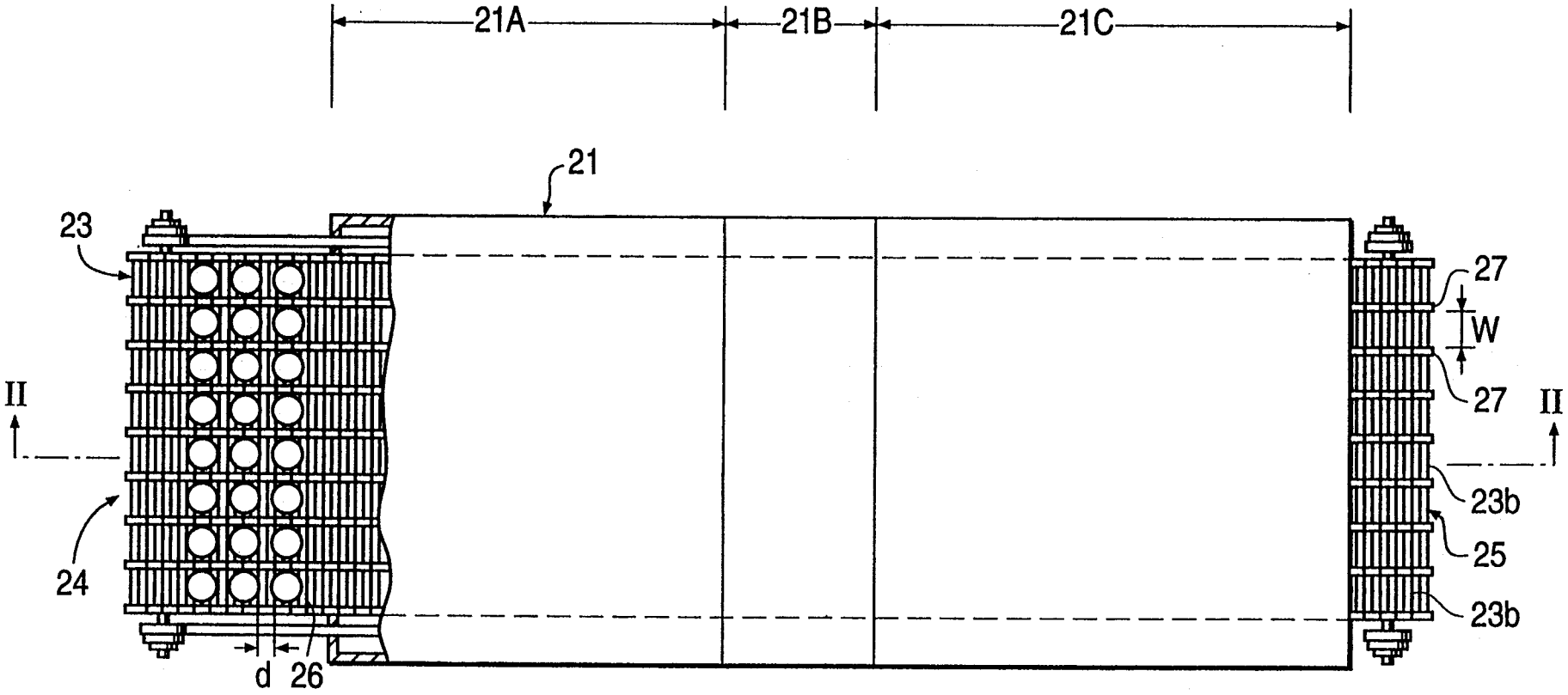
FIG. 1 is a plan view of an embodiment of the apparatus for carrying out surface treatment according to the invention.

Referring to FIG. 1, reference numeral 21 designates an apparatus according to the invention, comprising a tunnel in which a series of surface treatment processes take place continuously and the tunnel accommodates a pre-wash zone 21A comprising a de-oiling station 30 and a first wash station 31, a treatment zone 21B a chemical treatment station 32, and a post-wash zone 21C comprising a second wash station 33 and pure water (or deionized water) rinse station 34.

Figure 2:
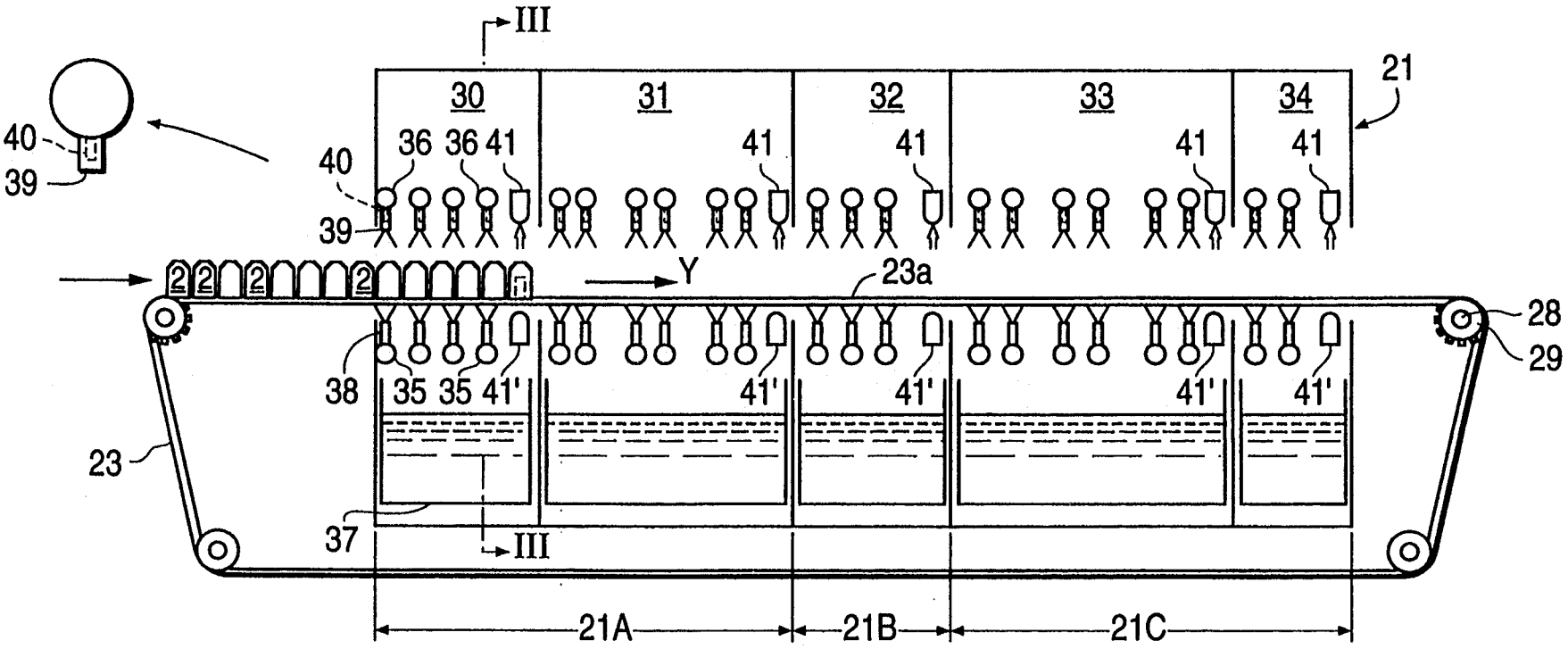
FIG. 2 is a sectional view taken along line II—II in FIG. 1.

As is seen from FIGS. 1 and 2, an endless conveyor belt 23 comprising rod forming an open framework supports drawn and ironed can bodies 2 in inverted states with their bottoms up and travels through the individual zones. The can bodies 2 have been trimmed to a predetermined height.

As the can bodies 2 held inverted on the conveyor belt 23 advance in the direction as shown by the arrow Y, from the upstream side 24 to the downstream side 25, they are subjected to de-oiling and first washing in the pre-wash zone 21A, chemical treatment in the treatment zone 21B and second washing and pure water (or deionized water) rinsing in the post-wash zone 21C. Thereafter, the can bodies are dried in a hot air drying oven (not shown).

A plurality of upper and lower nozzles are provided above and beneath the upper flight of the conveyor belt 23 for directing sprays of treatment liquid against the can bodies 2.

More specifically, reference numeral 35 designates lower nozzle headers disposed beneath the upper flight 23*a* of the conveyor belt 23 such that each header 35 extends across the belt substantially over its full width. Reference numeral 36 design upper nozzle headers disposed above the can bodies 2 on the conveyor belt such that each header 36 extends across the belt substantially over its full width. Each upper nozzle header 36 faces one of the lower nozzle headers 35 via the upper flight 23*a* of the conveyor belt and both cooperate as a pair. Pluralities of pairs of the upper and lower nozzle headers 35 and 36 are provided in the respective stations of zones 21A, 21B and 21C as spaced in the direction of travel of the conveyor belt. These headers 35 and 36 are respectively closed at one end 35*a* and 36*a* and connected by piping at the other ends 35*b* and 36*b* to liquid tanks 37 provided at each station beneath the conveyor belt (different treatment liquid tanks are provided for the respective stages). Treatment liquid is pumped from the respective liquid tanks through the connected nozzle headers 35 and 36, so that sprays of liquid are directed from lower and upper nozzles 38 and 39 mounted thereon against the can bodies and are returned to the respective tanks 37 in a well-known manner.

The upper nozzles may be well-known full-cone type spray nozzles to form a circular spray pattern or pyramid type spray nozzles to form a rectangular spray pattern and the lower nozzles to form a rectangular spray pattern and the lower nozzles may be well-known full-cone type spray nozzles, pyramid type spray nozzles or thin fan-shaped flat type spray nozzles to form a thin fan-shaped spray pattern. The lower nozzles 38 are provided on the top wall portions of the lower nozzle headers 35 such that each nozzle 38 is disposed right underneath the center line of a row of can bodies 2 received in one of can feeding sections as will be described later. The upper nozzles 39 are provided on the bottom wall portions of the upper nozzle headers 36 such that each nozzle 39 is disposed in alignment with one of the lower nozzles 38 via the upper flight 23*a* of the conveyor belt. Fluid pressure of the treatment liquid in each individual header can be independently controlled by means of flow control valves provided on connecting pipe lines. When fan-shaped flat type spray nozzles are used as the lower nozzles, they are arranged to direct sprays of a thin fan-shaped spray pattern transversely across the conveyor belt in such a manner that the pressure of the sprays will not force the can bodies into contact with one another.

Provided adjacent the downstream end of each stage are an air jet nozzle 41 for blowing off treatment liquid trapped in the recessed portions of the outer bottom surfaces of the can bodies 2 and a suction nozzle 41′ for sucking sprays of treatment liquid flowing along the sidewalls 2*c* and remaining at the open ends of the can bodies as well as treatment liquid picked up by the conveyer belt. The air jet nozzle 41 and the suction nozzle 41′ extend across the conveyor belt and face each other on the opposite sides of the upper flight 23*a* thereof, as shown in FIG. 2.

Figure 4:
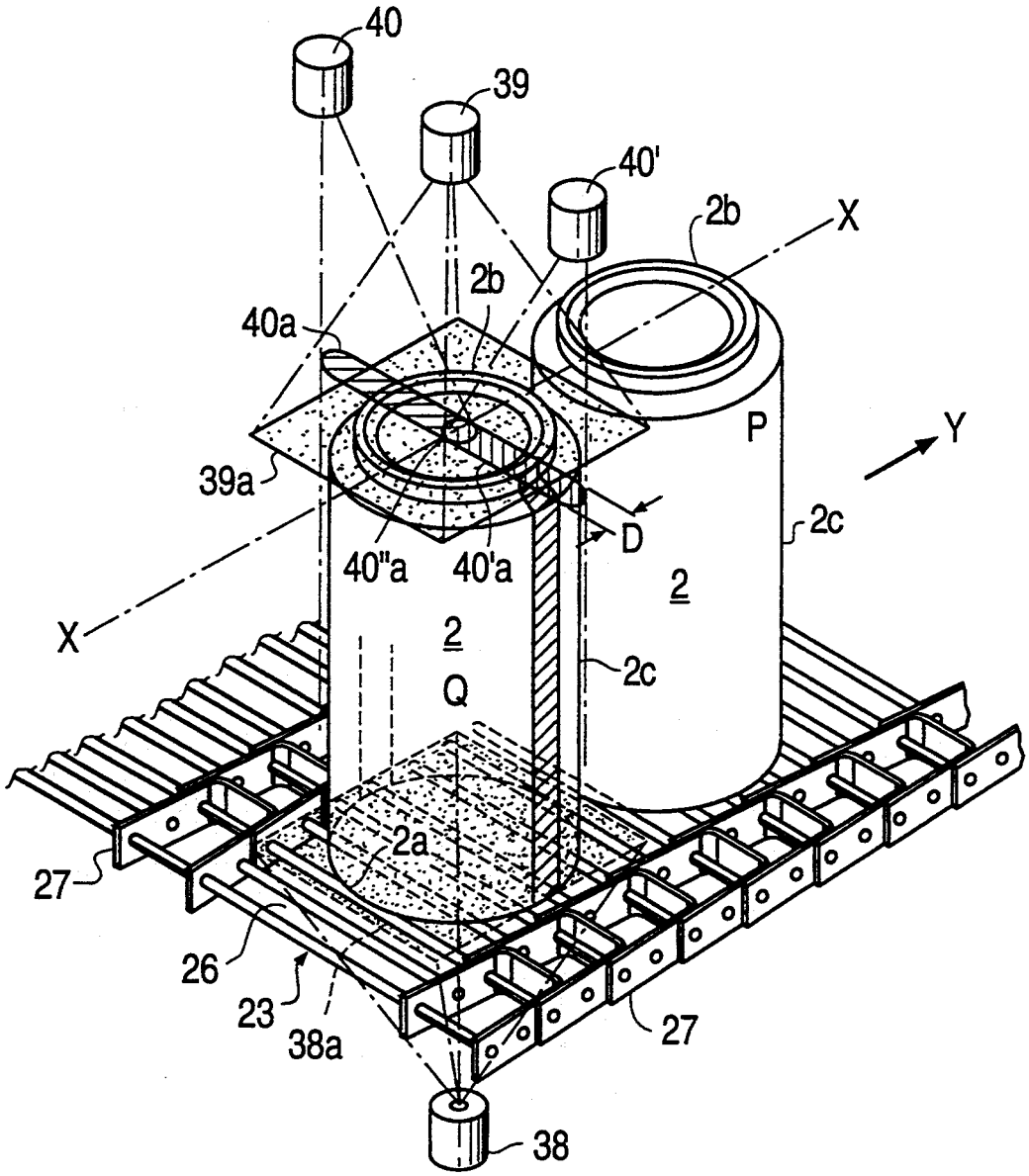
FIG. 4 is a perspective view, showing patterns of sprays directed from a set of nozzles against inverted can bodies in the embodiment.

The conveyor belt 23 comprises an endless belt of rods leaving a plurality of openings 26 which allow sprays of treatment liquid directed from the upper and lower nozzles to pass therethrough, and a plurality of particles 27 partitioning a plurality of rows of can bodies from on another and extending in the direction as shown by the arrow Y in FIG. 4. In this embodiment, the partitions 27 are formed by linkages of a plurality of U-shaped members. The partitions slightly project outwardly from the outer surface of the conveyor belt and define feeding sections 23*b* of the conveyor belt. Each can feeding section 23*b* has a width W a little greater than the diameter of the can bodies and receives the can bodies in a row. (In this embodiment, the width W is greater by 4 mm than the diameter of the can bodies. ) Thus, the can bodies are held in a row in each feeding section 23*b* and the partitions 27 restrict their sideway displacement so that they may not come into contact with the can bodies in adjacent rows.

The conveyor belt 23 is driven by an engagement of the links of the partition members with teeth of a plurality of associated sprockets 29 mounted on a drive shaft 28.

Figure 3:
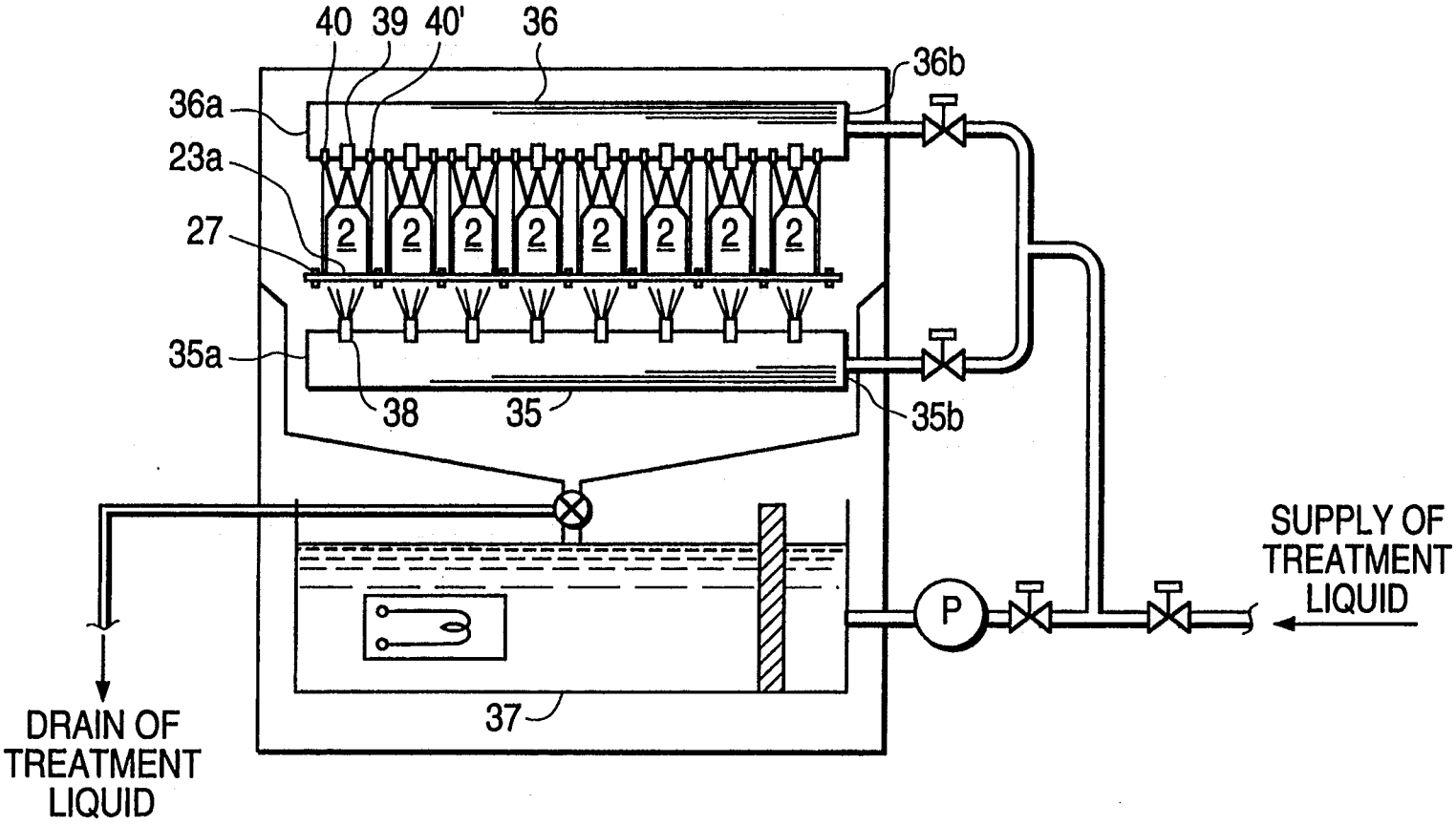
FIG. 3 is a sectional view taken along line III—III in FIG. 2.

FIG. 3 shows the can bodies 2 placed in a plurality of feeding sections 23*b* defined by adjacent partitions 27.

The bottom wall of each upper nozzle header 36 is further provided with a plurality of side spray nozzles 40 and 40′. On the header 36, the side spray nozzles 40 and 40′ are lined up with a plurality of the upper nozzles 39 and are mounted symmetrically each side of each upper nozzle. A pair of the opposed spray nozzles 40 and 40′ are spaced apart from each other by a distance not less than the diameter of the can bodies. (in this embodiment, the distance has been set to 100 mm for treating can bodies having diameters of 66 mm.)

The side spray nozzles 40 and 40′ are well-known flat type spray nozzles producing a thin fan-shaped spray pattern and are disposed in this embodiment above upper side portions of the can bodies being conveyed. These side spray nozzles receive treatment liquid from the upper nozzle headers 36.

Now, the surface treatment operation carried out by the aforementioned apparatus will be described.

Can bodies 2 are distributed in rows on the can feeding sections 23*b* of the conveyor belt 23 in an inverted state with their bottoms facing up. In each can feeding section 23*b*, adjacent can bodies are spaced apart from each other by a distance of 5 mm (the distance is designated by d in FIG. 1.)

Figure 5:
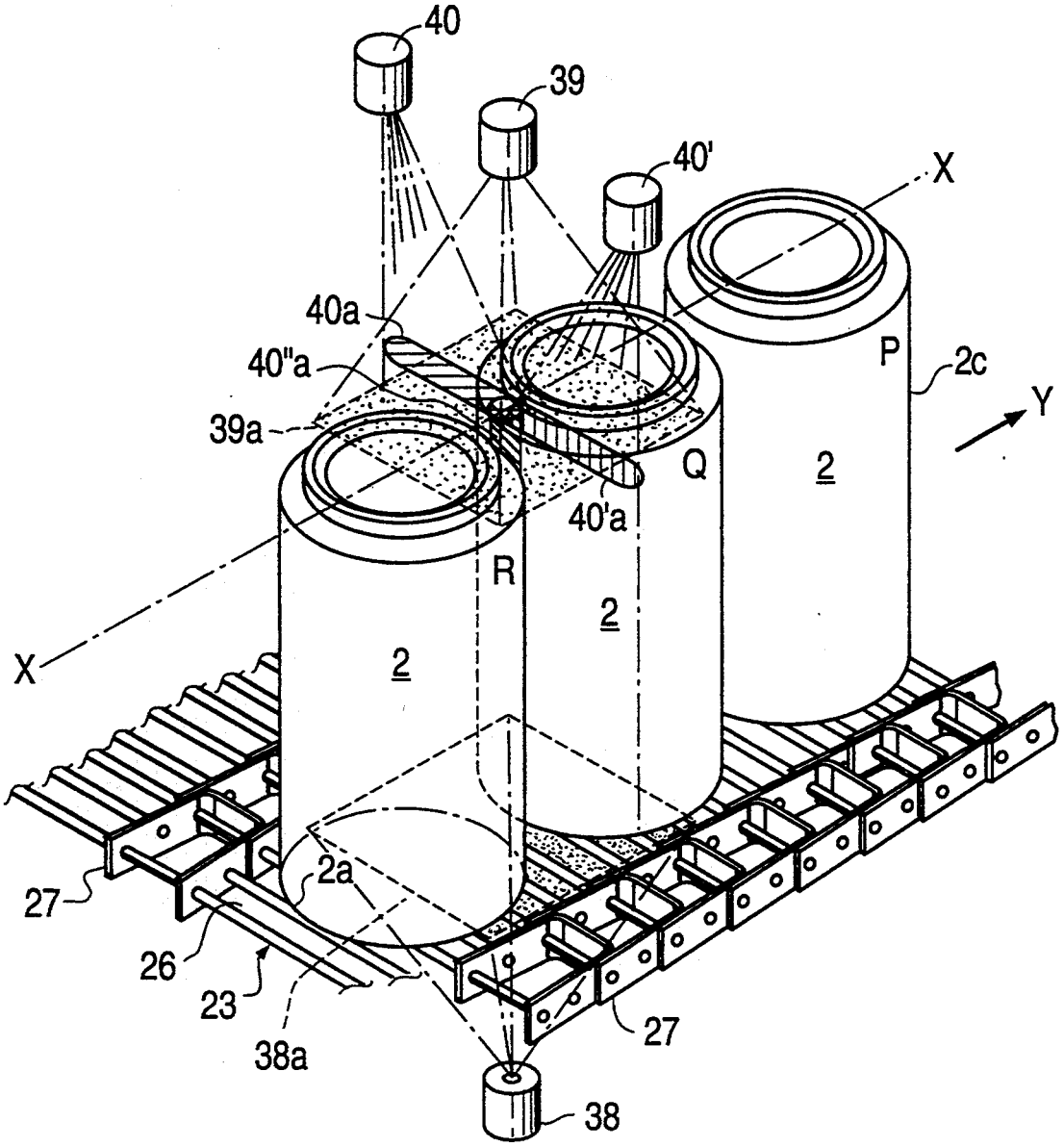
FIG. 5 is a view similar to FIG. 4 but showing spray patterns related to the inverted can bodies which have advanced by a distance equivalent to a half of the center-to-center distance between adjacent cans from the state shown in FIG. 4.

FIGS. 4 and 5 illustrate a manner of directing sprays of the treatment liquid from a set of nozzles 38, 39, 40 and 40'. In FIG. 4, an inverted can body Q in Can feeding section 23*b* is right underneath the upper nozzle and FIG. 5 shows the can body Q just advanced by a half of the center-to-center distance between adjacent can bodies in the direction Y and the space between the can body Q and the next can body R is right underneath the upper nozzle. At this moment, the sprays of treatment liquid directed from the side spray nozzles 40 and 40' collide with each other and scatter in the space to create turbulent-flows.

The lower nozzle 38 is a well-known pyramid type spray nozzle provided to direct sprays of the treatment liquid upwardly through the upper flight 23*a* of the conveyor belt. On a plane coincident with the open end 2*a* of the can body Q, sprays from the lower nozzle 38 are uniformly disposed in a square spray pattern 38*a* over an area slightly greater than the circular area defined by the annular edge of the open end 2*a* of the can body.

The upper nozzle 39, which is vertically aligned face-to-face with the lower nozzle 38, is again a pyramid type spray nozzle provided to direct sprays of the treatment liquid downwardly against the outer bottom surface 2*b* of the inverted can body. On the plane coincident with the top rim portion of the outer bottom surface 2*b* of the inverted can body, sprays from the upper nozzle are uniformly disposed in a square spray pattern 39*a* over an area slightly greater than the circular area defined by the periphery of the sidewall of the can body.

The pair of the side spray nozzles 40 and 40' are well-known flat type spray nozzles and sprays of the treatment liquid are directed obliquely downwardly against the outer bottom surface 2*b* of the can body. Sprays of the treatment liquid from both side spray nozzles are directed under a uniform spray pressure (4 kg/cm$^2$ in this embodiment) in a transversely symmetrical thin fan-shaped spray pattern with respect to the center line X—X of a row of the can bodies in the can feeding section. The sprays of treatment liquid directed from the two nozzles 40 and 40' meet with each other and thus form spray patterns 40*a* and 40'*a* having an overlapped portion 40''*a* on the plane containing the top rim portion of the outer bottom surface 2*b* of the can body. Since the two nozzles 40 and 40'' are spaced apart from each other by a distance greater than the diameter of the can body, the sprays of the treatment liquid directed from them are disposed over areas, at both sides of the can body, extending beyond the sidewall 2*a*. In this embodiment, the width of the sprays 40*a* and 40'*a* is set by at 8 mm. (The width is designated at D in FIG. 4.)

Further, the spray pressures from the upper and lower nozzles 39 and 38 are set at 5 and 4 kg/cm$^2$ respectively, for preventing the can body from floating off of the conveyor belt.

Figure 7:
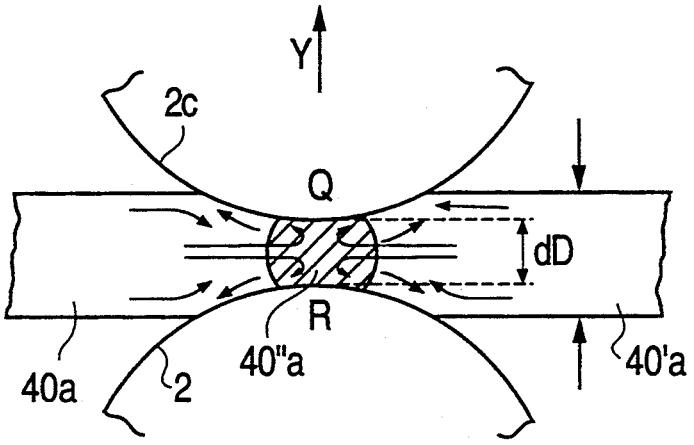
FIG. 7 is a plan view showing the state of sprays of treatment liquid directed towards the space between the can bodies from two opposed side spray nozzles and colliding with each other.
Figure 8:
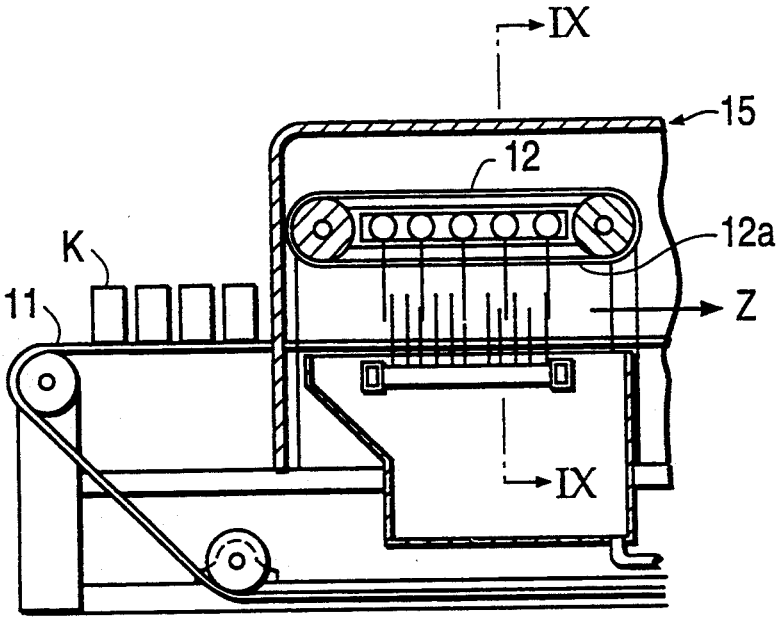
FIG. 8 PRIOR ART
FIG. 8 is a fragmentary sectional view of a prior art can surface treatment apparatus.
Figure 9:
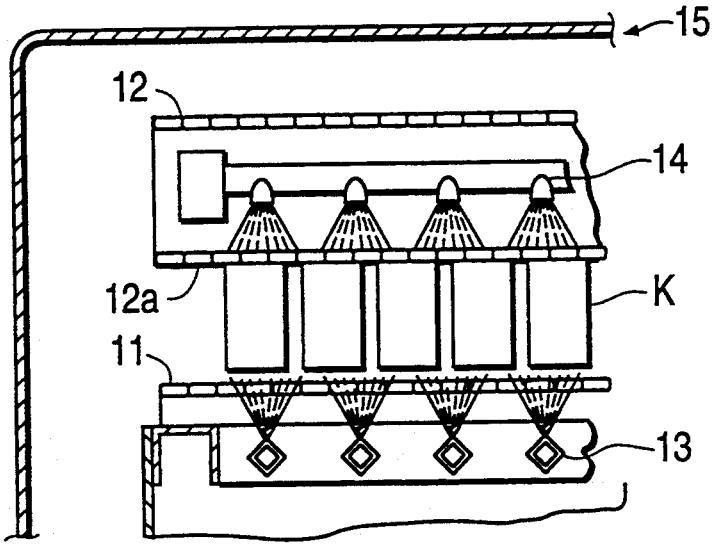
FIG.9 PRIOR ART
FIG. 9 is an enlarged sectional view, taken along line IX—IX of FIG. 8.

FIG. 7 shows the state in which sprays of the treatment liquid directed from the side spray nozzles 40 and 40' are colliding with each other to form turbulent flows in the space between adjacent cans (Q and R, for instance).

As a consequence of the aforementioned arrangements, those portions of sidewalls 2*c* of adjacent can bodies that face one another, which have heretofore been difficult portions to treat efficiently, can receive sufficient turbulent flows of sprays of the treatment liquid, so that the sidewalls are treated uniformly and efficiently. In addition, relatively high pressure created in the space d due to an accumulation of sprays of the treatment liquid serves to force adjacent can bodies in the can feed section away from one another and thus prevent can-to-can contacts and the occurrence of defects that may result therefrom while, in the prior art methods, sprays of surface treatment liquid just flow through gaps between adjacent can bodies, so that when a can body has just advanced past the sprays, a negative pressure is created momentarily in the gaps to pull the adjacent can bodies, causing can-to-can contacts and resultant defects.

As such, the embodiment of a method and apparatus according to the present invention successfully eliminates can-to-can contacts by controlled forces of spray pressures and ensures adequate surface treatment of drawn and ironed lightweight can bodies that can be readily displaced by impingements of even slightly imbalanced sprays.

Specific experiments using an apparatus according to the invention are described below together with comparative examples.

In an experiment of the inventors, 10,000 pieces of drawn and ironed lightweight 350 ml aluminum cans (each weighing about 12 g) were surface treated by a method and an apparatus according to the present invention. The speed of the endless conveyor belt was set at 15 m/min. so as to provide the cans for about 30 seconds. The apparatus was equipped with "Model $\frac{1}{8}$ GGSS 3.6SQ" upper nozzles and "Model H $\frac{1}{8}$ U-3.6SQ" lower nozzles (both manufactured by Spraying System Japan, Inc.) and the respective spray pressures and flow rates were set at 5 kg/cm$^2$ and 3.4 l/min. for the upper nozzles and 4 kg/cm$^2$ and 3.0 l/min. for the lower nozzles, respectively. The side spray nozzles used with the apparatus were "Model $\frac{1}{4}$ KSH0440" nozzles (manufactured by Eveloy Inc.) to produce 8 mm thick fan-shaped sprays and the respective spray pressure and flow rate from the side spray nozzles were set at 4 kg/cm$^2$ and 6.6 l/min. (it should be noted that, in the treatment and post-wash zones, the spray pressures from the respective nozzles may be reduced as required.)

In the above experiment, the cans were distributed onto each can feeding section of the apparatus with a can-to-can spacing of 5 mm in their direction of travel and surface treated.

These can were visually checked at the exit of the apparatus and found to be completely free from tipping over or can-to-can contacts.

Moreover, a band of dark scars around lower sidewall portions near the rim of, or nicks at the edge of the open end of, a can that may often develop in the conventional surface treatment were not found at all in the cans in this experiment. Also, these cans were completely free from undesired frosted surfaces that might be found in their internal surfaces if they had not been adequately washed. As such, the inventors have identified that the cans which were surface treated by the apparatus in the experiment have a greatly improved and superior surface finish.

Further experiments were carried out by varying the conditions of the side sprays and it has been found that similarly satisfactory results are obtained so long as the side spray pressure, flow rate and spray width D meet the following conditions.

Pressure: 2 to 5 kg/cm$^2$

Flow rate: 6 to 10 l/min.

Spray width D: 2 to 10 mm.

Likewise, an experimental use of flat spray nozzles ("Model HI/8U-8010" manufactured by Spraying System Japan Inc. ) as the lower nozzles in lieu of the pyramid type spray nozzles also showed satisfactory results similar to those obtained by the latter.

The above surface treated cans were subsequently coated and printed and no noticeable problem was identified in terms of quality of the finish, adhesion performance of the coating, etc.

For comparison, another experiment was carried out using a prior art apparatus of the type disclosed in U.S. Pat. No. 3,952,698 which does not have a can holding mechanism. The conveyor speed of the prior art apparatus was set at 15 meters/min. and lightweight 350 ml aluminum cans were surface treated and inspected. The results of the experiment are shown as Comparative Example 1 in Table 1 which indicates that the prior art apparatus could not perform satisfactorily at a high production speed due to frequent occasions of tipping over of cans and can-to-can contacts which result in unsatisfactory surface treatment. For further comparisons, results of inappropriate side spray conditions in the aforementioned experiments using the method and apparatus according to the present invention are also shown in Table 1 as Comparative Example 2 (in which the spray pressure and the flow rate were too low and the spray width D was too narrow), Comparative Example 3 (in which the spray pressure and the flow rate were too high) and Comparative Example 4 (in which the spray pressure was too high and the spray width D was too wide). Comparative Example 5 in the Table shows results obtained when the spray pressure, the flow rate and the spray width D were within the desired ranges but the flat spray nozzles were used as the lower nozzles and positioned such that the elongate sides of the spray pattern produced by such nozzles extended in the direction of travel of the conveyor belt.

TABLE 1

Results of Surface Treatment of 10,000 350-ml aluminum cans

| | | C.E. 1 | C.E. 2 | C.E. 3 | C.E. 4 | C.E. 5 |
|---|---|---|---|---|---|---|
| Conveyor speed: | | 15 m/min. | | | | |
| Surface treatment time: | | about 30 seconds | | | | |
| Upper nozzle | Pressure (kg/cm$^2$) | 4 | 5 | 5 | 5 | 5 |
| | Flow rate (l/min.) | 3.0 | 3.4 | 3.4 | 3.4 | 3.4 |
| Lower nozzle | Pressure (kg/cm$^2$) | 4 | 4 | 4 | 4 | 4 |
| | Flow rate (l/min.) | 3.0 | 3.0 | 3.0 | 3.0 | 3.0 |
| Side spray | Pressure (kg/cm$^2$) | None | 1 | 6 | 8 | 4 |
| | Flow rate (l/min.) | None | 4.5 | 11 | 6.6 | 6.6 |
| | Width (mm) | None | 1 | 10 | 12 | 5 |
| Can to can spacing d (mm) | | Nil (distributed in a mass) | Nil (lined up in close contact) | 5 | 5 | 5 |
| Tipped over (%) | | 0.01 | 1.0 | 50 | 80 | 30 |
| Can-to-can contacts (%) | | 100 | 100 | 20 | 30 | 10 |

(Note)
"C.E." refers to Comparative Example.

Figure 6:
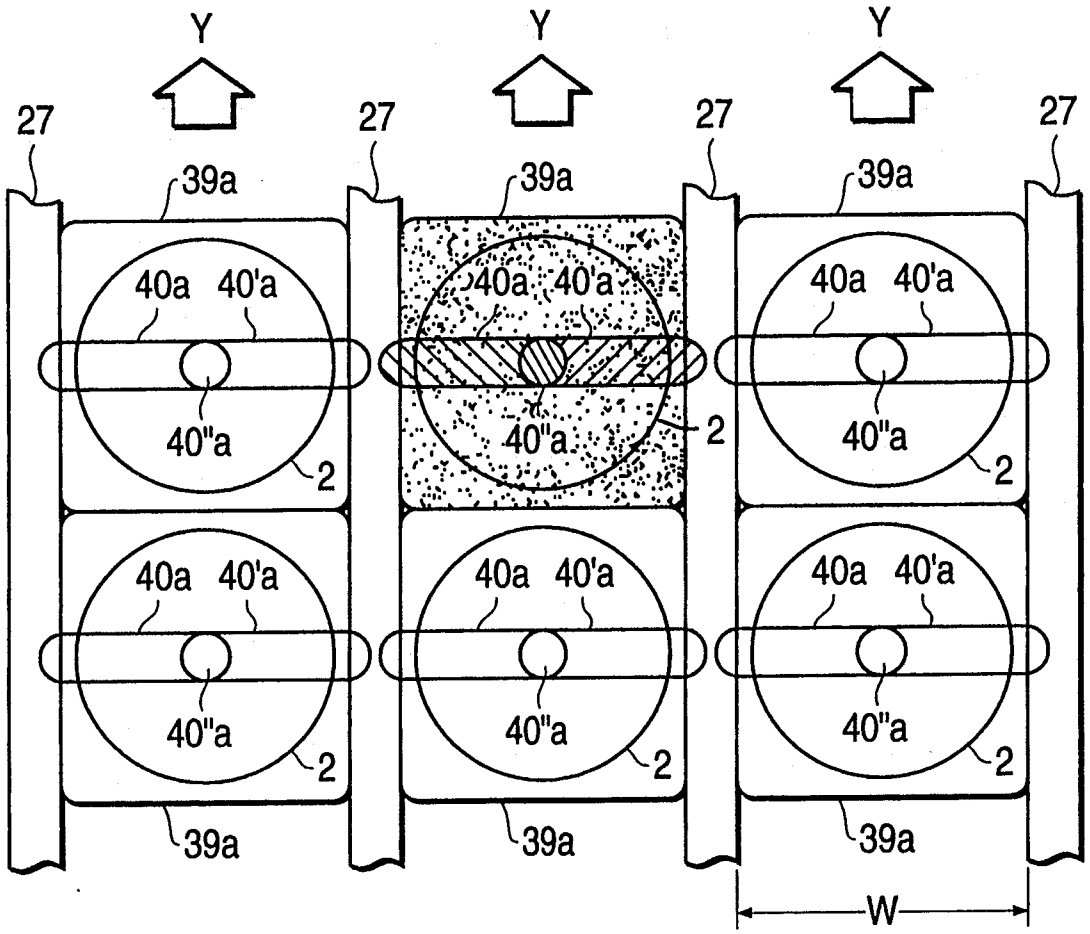
FIG. 6 is a fragmentary plan view showing spray patterns on a plane in which the annular rim portions of the outer bottom surfaces of the can bodies being treated lie.

In the above embodiment, the lower and upper nozzles 38 and 39 are pyramid type spray nozzles, and the spray patterns 38*a* and 39*b* are thus square. Although full-cone type spray nozzles providing circular spray patterns can be used as the upper and lower nozzles, the pyramid type spray nozzles are more preferably from the standpoint of the stability of cans. Sprays of the square pattern can be arranged to form continuous bands of uniformly distributed sprays extending in the direction of travel of can bodies 2 as shown in FIG. 6, so that all can bodies regardless of their positions in can feeding sections may be subjected to a uniform spray pressure and held stably.

Further, in the above embodiment the side spray nozzles 40 and 40' on each header are lined up with the upper nozzles mounted thereon and paired nozzles 40 and 40' are spaced apart from each other by a distance greater than the diameter of the can bodies and disposed above the can bodies in one of the can feeding sections at positions transversely symmetrical positions to each other with respect to the center line of the can feeding section, so that sprays of the treatment liquid are directed obliquely downwardly towards central portions of the can feed section to cover the sidewall and outer bottom surfaces of the can bodies.

Of course, each can feeding section may be sufficiently spaced from another to accommodate the side spray nozzles at an elevation below the outer bottom surface of the can bodies in the can feeding sections, and in this case sprays of the treatment liquid cover the sidewalls of the can bodies. It is to be noted that, in any case, the side spray nozzles should be arranged to create turbulent flows of sprays of the treatment liquid at spaces between adjacent can bodies in the can feeding section.

While the side spray nozzles and the upper nozzles are in a linear arrangement in this embodiment, these nozzles do not necessarily have to be lined up but either of them may be positioned upstream or downstream of the other so long as any pair of such side spray nozzles 40 and 40' are arranged at transversely symmetrical positions with respect to the center line of one of the can feeding section and sprays directed from both of the paired nozzles meet each other and cause turbulent flows at spaces between adjacent cans in the can feeding section.

As has been described in the foregoing, of surface treatment according to the invention prevents adjacent cans in each of a plurality of partitioned rows from getting into contact with each other with sprays directed at central portions of the respective rows from symmetrically disposed opposite side spray nozzles, so that the sidewall portions of adjacent cans, which portions have hitherto been difficult to handle, can be surface treated sufficiently to eliminate defects such as those caused irregular wash patterns and thus improve quality of can bodies in terms, for example, of affinity to coatings to be applied.

Further, can bodies to be treated are urged downwardly and prevented from floating off of the conveyor belt by the downwardly directed sprays having a higher fluid pressure relative to the upwardly directed sprays, so that the can bodies are free from coming into contact with one another during their travel and held stably on the conveyor belt without the use of any can holding mechanism such as an upper belt conveyor or an upper guide which has heretofore been necessary. The aforementioned arrangements, in conjunction with the obliquely downwardly directed sprays of treatment liquid from the side spray nozzles ensure highly reliable and efficient surface treatment of drawn and ironed lightweight can bodies. Since there is no can-to-can contact during surface treatment by a method according to the invention, sprays of treatment liquid picked up by the sidewalls of can bodies are drained quickly so that the surface treatment time can be reduced.

What is claimed is:

1. An apparatus for treating the surface of drawn and ironed can bodies, said apparatus comprising: a tunnel in which a series of pre-wash, treatment and post-wash zones are defined; an endless conveyor belt of rods in the form of an open framework, and a plurality of partitions projecting outwardly from an outer surface of the endless conveyor belt defined by said rods, said partitions extending in the direction of travel of the conveyor to form a plurality of separated can feeding sections of the conveyor, and said endless conveyor having upper and lower flights, said upper flight extending through said zones; a plurality of upper and lower nozzles disposed above and beneath said upper flight of the conveyor and oriented to direct sprays of treatment liquid upwardly from beneath and downwardly from above the upper flight of said conveyor belt; and a plurality of flat fan-shaped type side spray nozzles oriented to direct sprays of treatment liquid towards centers of said can feeding sections as taken between said partitions, said upper nozzles being full-cone or pyramid type spray nozzles, said lower nozzles being full-cone, pyramid or flat fan-shaped type spray nozzles, pairs of the upper and lower spray nozzles being vertically coaxially aligned with each other, respectively, and respective ones of said side spray nozzles being disposed at transversely symmetrical positions with respect to the center of each said can feeding section, each pair of spray nozzles disposed at the transversely symmetrical positions oriented to spray treatment liquid toward the center of a respective said can feeding section.

2. An apparatus for surface treatment according to claim 1, wherein said upper nozzles and said side spray nozzles are disposed at a common elevation.

3. In a manufacturing line for mass producing drawn and ironed can bodies, an apparatus for treating the surface of trimmed can bodies, the apparatus comprising: a tunnel in which a series of pre-wash, treatment and post-wash zones are defined; an endless conveyor belt of rods in the form of an open framework, and a plurality of partitions projecting outwardly from an outer surface of the endless conveyor belt defined by said rods, said partitions extending in the direction of travel of the conveyor to form a plurality of separated can feeding sections of the conveyor, said partitions being spaced apart from one another by distances each slightly greater than the diameter of the can bodies, said endless conveyor having upper and lower flights, said upper flight extending through said zones and supporting the trimmed can bodies on the upper flight thereof in an inverted state in which closed bottoms of the can bodies face upwardly; a plurality of upper and lower nozzles disposed above and beneath said upper flight of the conveyor and oriented to direct sprays of treatment liquid upwardly from beneath and downwardly from above the upper flight of said conveyor belt against the inner and outer surfaces of the can bodies supported by the upper flight of the conveyor; and a plurality of flat fan-shaped type side spray nozzles oriented to direct sprays of treatment liquid towards centers of said can feeding sections as taken between said partitions, said upper nozzles being full-cone or pyramid type spray nozzles, said lower nozzles being full-cone, pyramid or flat fan-shaped type spray nozzles, the upper and lower spray nozzles being vertically coaxially aligned with each other, respectively, and respective ones of said side spray nozzles being disposed at transversely symmetrical positions with respect to the center of each said can feeding section, the side spray nozzles of each pair thereof disposed at the transversely symmetrical positions being spaced apart from each other by a distance equal to or greater than the diameter of the can bodies and oriented to spray treatment liquid toward the center of a respective said can feeding section.

4. The apparatus for treating the surface of trimmed can bodies in a manufacturing line for mass producing the can bodies as claimed in claim 3, wherein said side nozzles are disposed at an elevation higher than the outer bottom surfaces of the can bodies supported on the upper flight of the endless conveyor in an inverted state.

5. The apparatus for treating the surface of trimmed can bodies in a manufacturing line for mass producing the can bodies as claimed in claim 3, wherein said upper nozzles and said side spray nozzles are disposed at a common elevation.

* * * * *